US008746150B2

(12) United States Patent
Traverso

(10) Patent No.: US 8,746,150 B2
(45) Date of Patent: Jun. 10, 2014

(54) MOTORIZATION KIT FOR A STORAGE SYSTEM WITH MOBILE CABINETS

(75) Inventor: Mario Traverso, Milan (IT)

(73) Assignee: Addicalco Logistica S.r.l., Buccinasco (MI) (IT)

( * ) Notice: Subject to any disclaimer, the term of this patent is extended or adjusted under 35 U.S.C. 154(b) by 0 days.

(21) Appl. No.: 13/635,550

(22) PCT Filed: Mar. 15, 2011

(86) PCT No.: PCT/IB2011/051078

§ 371 (c)(1),
(2), (4) Date: Nov. 20, 2012

(87) PCT Pub. No.: WO2011/114289

PCT Pub. Date: Sep. 22, 2011

(65) Prior Publication Data

US 2013/0069509 A1 Mar. 21, 2013

(30) Foreign Application Priority Data

Mar. 18, 2010 (IT) ..... MI2010A0441

(51) Int. Cl.
*B61C 1/00* (2006.01)

(52) U.S. Cl.
USPC ..... 105/133; 105/140

(58) Field of Classification Search
USPC ..... 105/133–140
See application file for complete search history.

(56) References Cited

U.S. PATENT DOCUMENTS

| | | | | |
|---|---|---|---|---|
| 2012/0176734 | A1* | 7/2012 | Fontana et al. | 361/622 |
| 2012/0280602 | A1* | 11/2012 | Baker | 312/236 |
| 2013/0049558 | A1* | 2/2013 | Hsiao | 312/249.1 |
| 2013/0069509 | A1* | 3/2013 | Traverso | 312/249.1 |

FOREIGN PATENT DOCUMENTS

| | | | | |
|---|---|---|---|---|
| GB | 2360071 A | * | 9/2001 | A47B 53/02 |
| GB | 2411648 A | * | 9/2005 | A47B 53/02 |
| WO | WO 03097491 A1 | * | 11/2003 | B65G 1/10 |

* cited by examiner

*Primary Examiner* — Jason C Smith
(74) *Attorney, Agent, or Firm* — Notaro, Michalos & Zaccaria P.C.

(57) ABSTRACT

A motorization kit for a storage system with mobile cabinets comprises a box-like body for fixing the motorization kit to a mobile cabinet, which houses: an electric motor, a driven pinion designed to be keyed to the drive shank of the mobile cabinet, mechanical drive for kinematically rotatably connecting the shaft of the electric motor and the driven pinion, electronic adjustment and control for managing the operation of the motor, an actuation mechanism for providing an enable signal to the electronic adjustment and control, for rotary actuation of the motor and a safety mechanism for stopping the motor in response to a signal emitted as an obstacle is found along the path of the mobile cabinet.

16 Claims, 6 Drawing Sheets

MOTORIZATION KIT FOR A STORAGE SYSTEM WITH MOBILE CABINETS

The present invention relates to a motorization kit for a storage system with mobile cabinets as defined in the preamble of claim 1.

In a further aspect, the invention also relates to a mobile cabinet as defined in the preamble of claim 10 or 11, as well as a storage system with mobile cabinets as defined in the preamble of claim 13 and a method of motorizing a storage system with mobile cabinets as defined in claim 16.

In the field of storage cabinets, storage systems with mobile cabinets are widely used, in which the cabinets are packed together or lean against each other and are movable along special floor-mounted rails, individually or in combination to create a passageway between two contiguous mobile cabinets.

These cabinets afford optimization of storage spaces because, unlike storage systems with fixed cabinets, they only require the space for a single empty compartment/passageway, all the remaining space being useful for storage.

The mobile cabinets may be moved by pushing them, but this solution is not suitable for large cabinets. As a rule, mobile cabinets are moved by rotating an operating member, such as a handwheel or a handle, which is kinematically connected by mechanical transmission means to one or more pinions meshing with special racks located in the floor-mounted rails.

Since mobile cabinets are required to be packed together in side-by-side arrangement, with the front side of a cabinet substantially adhering against the back side of the cabinet next to it, said handwheel must be located at one lateral side of the mobile cabinet.

It should be noted that, in addition to the difficulties of manual cabinet displacement, these cabinets have the drawback that, if the floor along which the support guides extend is not perfectly coplanar, the inclination of the support guides may cause an undesired effect of gravity displacement of the mobile carriages.

It shall be noted in this respect that this drawback cannot be easily and simply obviated because, in order to level the support surface of the guides, the mobile cabinets must be first emptied of the material stored therein, which involves a waste of time and especially space, as space is required for temporary storage of the material previously stored in the cabinets.

In an attempt to obviate the above drawback, safety devices have been provided, such as brakes and the like which, upon engagement, can prevent the displacement of the mobile cabinets.

Concerning these safety devices, it shall be noted that, in spite of their effectiveness, they are no ideal solution to the problem, because their engagement is not automatic, but is decided by the user of the storage system.

Furthermore, a motorized drive was suggested for the mobile cabinets, so that the mobile cabinets can be stopped by the mechanical locking action ensured by the motors when they are not powered.

Nevertheless, it shall be noted that, in prior art motorized storage systems, the known cabinets were motorized by arrangements that involved certain drawbacks, associated with:

- the difficulty of ensuring appropriate grounding for 220V powered motors,
- the difficulty of installing a motor on board a mobile cabinet, at the pinions that mesh with the floor-mounted racks, and
- the difficulty of electrically connecting the cabinets together to ensure power supply to the electric motors.

Furthermore, it shall be noted that, in a storage system that already requires a solution to the above mentioned rail inclination problem, it will not be easy to mount a motor to a pinion engaged with a floor-mounted rack.

Therefore, there arises the need of obviating the problem of the inclination of the guide rails that support the mobile cabinets, by a simple, inexpensive and easily mountable solution that can be implemented without requiring any excessive change or customization of pre-existing storage systems.

This invention is based on the problem of conceiving a motorization kit for a storage system with mobile cabinets that has such structural and functional characteristics as to fulfill the above need, while obviating the above prior art drawbacks.

This problem is solved by a motorization kit for a storage system with mobile cabinets according to claim 1.

According to a further aspect, this problem is solved by a mobile cabinet as defined in the preamble of claim 10 or 11, as well as a storage system with mobile cabinets according to claim 13 and a method of motorizing a storage system with mobile cabinets according to claim 16.

Further features and advantages of the motorization kit of a storage system with mobile cabinets of this invention will be apparent from the following description of one preferred embodiment thereof, which is given by way of illustration and without limitation with reference to the accompanying figures, in which.

Figure 1:
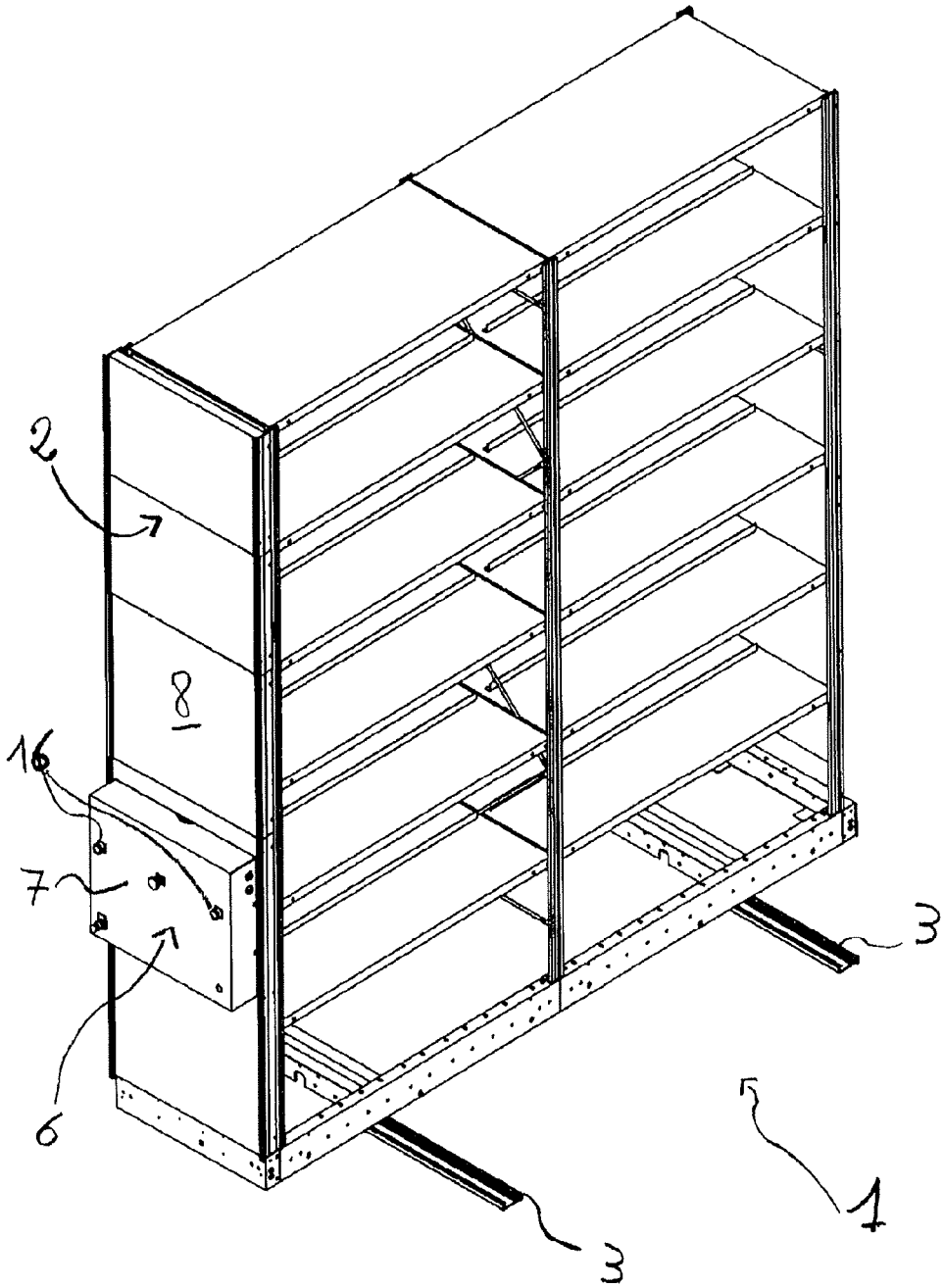
FIG. 1 is a perspective view of a mobile cabinet with the motorization kit of this invention mounted thereto.
Figure 2:
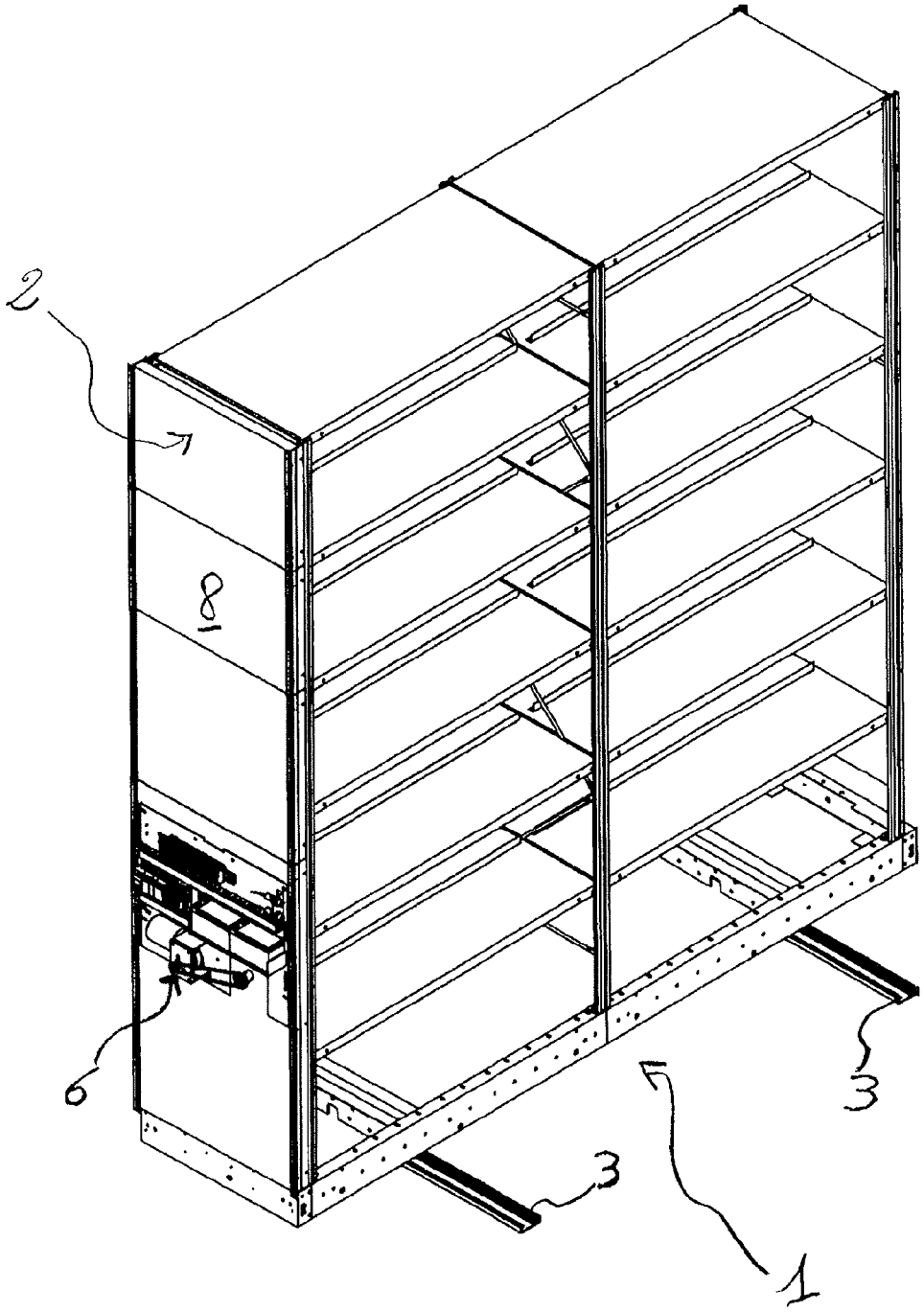
FIG. 2 shows the cabinet of FIG. 1 with the motorization kit of the invention shown without its cover.
Figure 3:
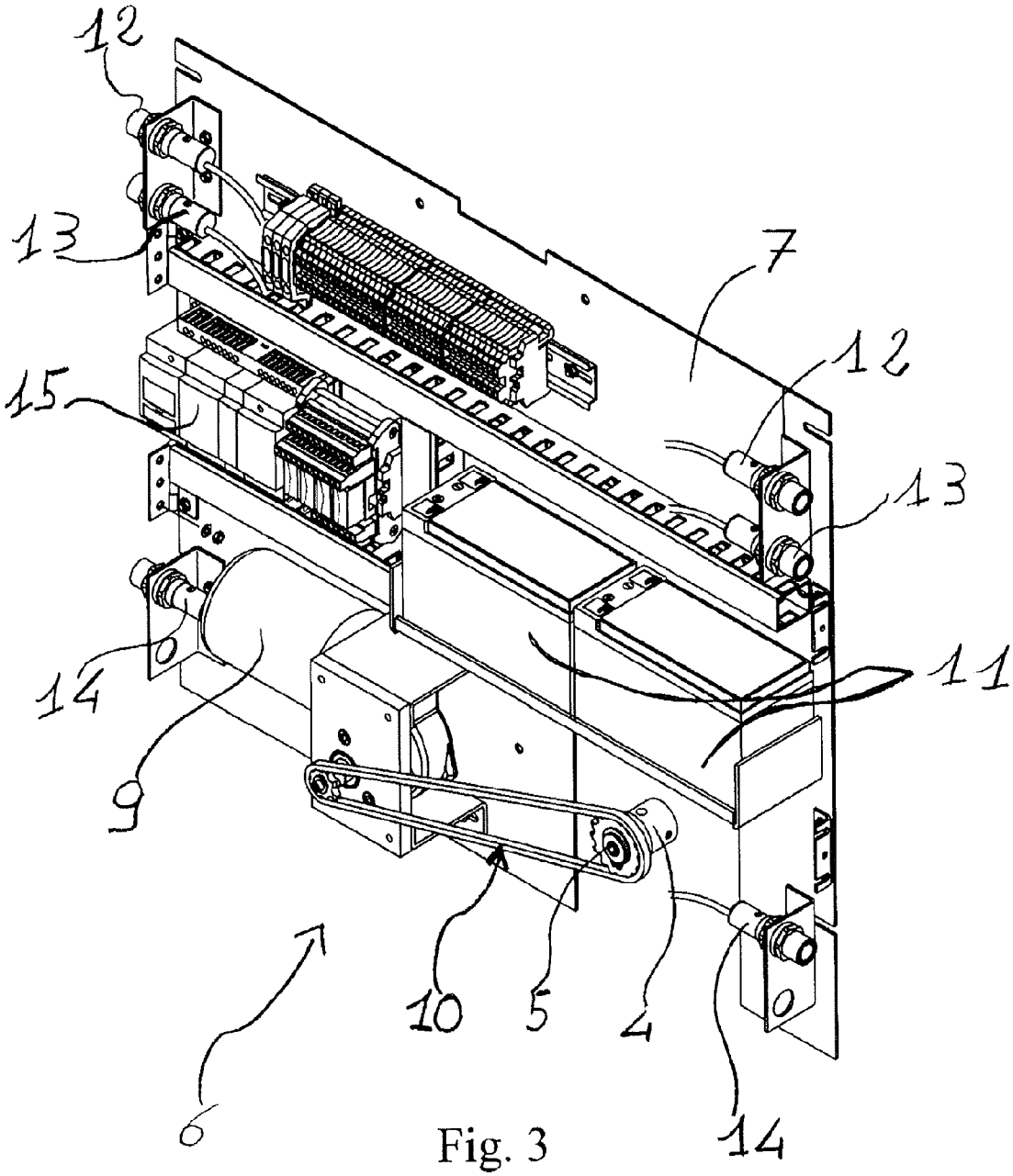
FIG. 3 is a schematic and enlarged perspective view of the motorization kit of the invention.
Figure 4:
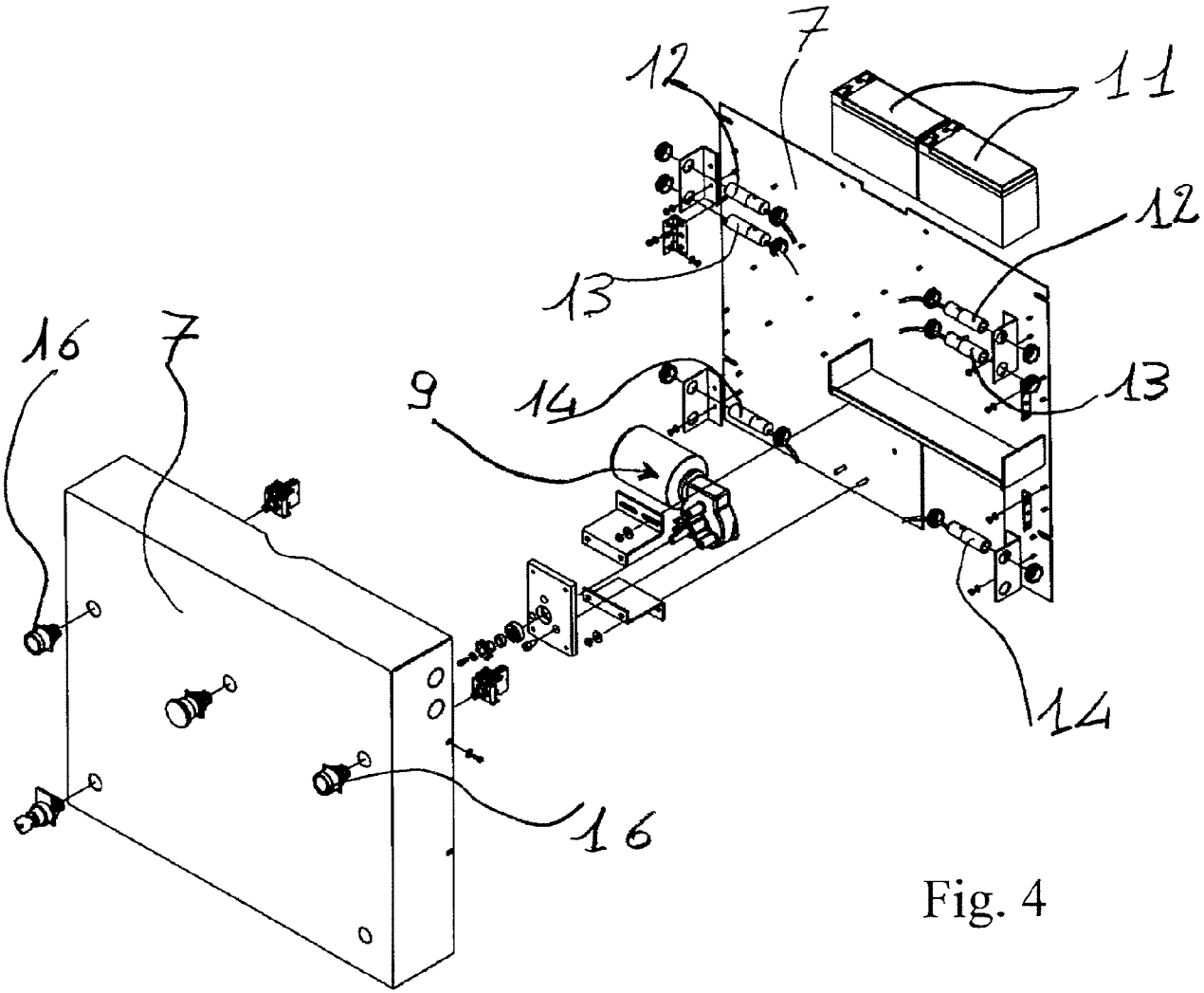
FIG. 4 is a schematic and enlarged perspective view of the motorization kit of the invention.
Figure 5:
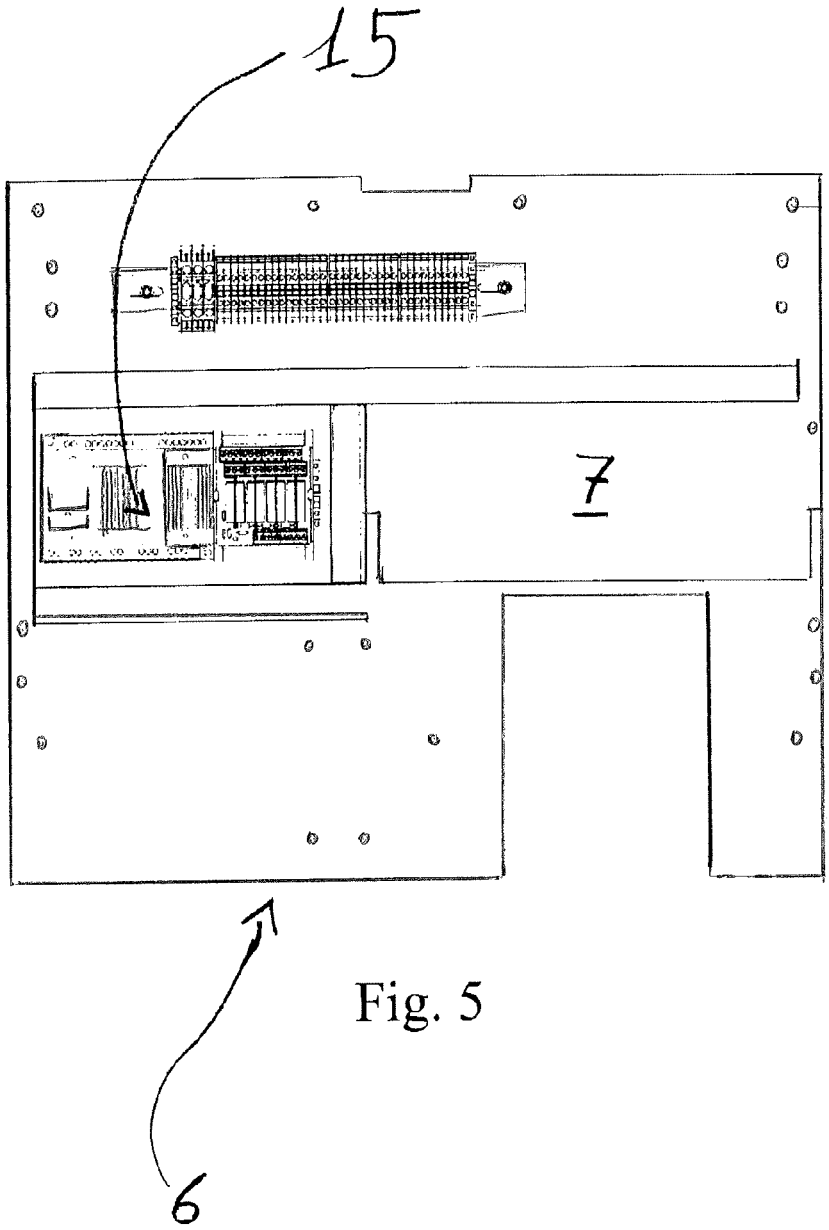
FIG. 5 shows a few components of the motorization kit of the invention.
Figure 6:
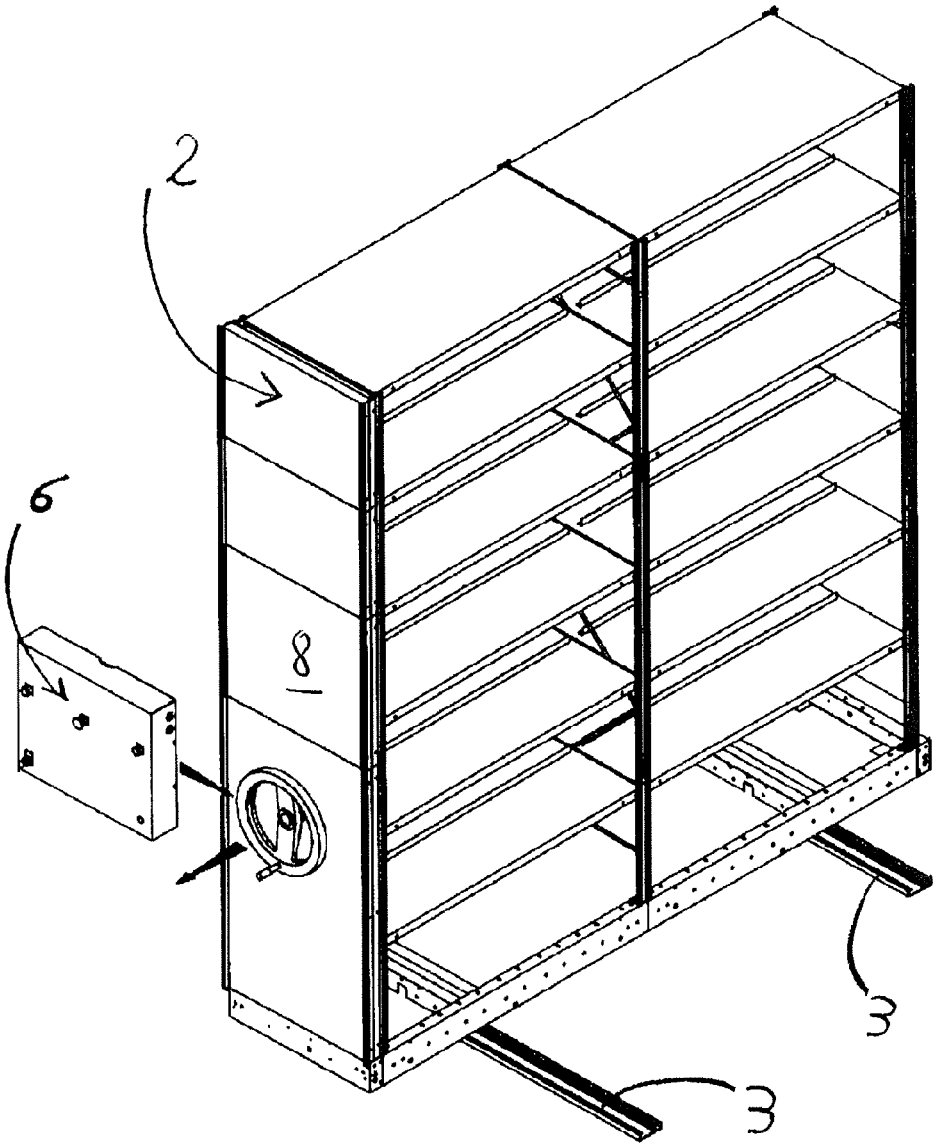
FIG. 6 shows a mobile cabinet of the prior art, which shows how the manual drive member is replaced by the motorization kit of the invention.

Referring to the annexed figures, numeral 1 generally designates a storage system with mobile cabinets of the invention, which is composed of a plurality of mobile cabinets 2 slideably mounted to common slide guides 3.

The mobile cabinets 2 are disposed in parallel arrangement along said rails 3, to be packed together at their larger front and back sides and to be separated, as needed, into two groups spaced by a preset distance along said rails 3. As two contiguous cabinets are spaced, a passageway is defined between such mobile cabinets, allowing a user to access the documents stored in a particular mobile cabinet.

For displacement of the mobile cabinets 2, each of the latter is equipped with mechanical drive means for causing the mobile cabinet to move forward along the rails 3. Concerning these mechanical means, it shall be noted that they may be of various types, including for instance rack and wheel assemblies or others, e.g. involving the use of drive pulleys and/or drive belts or chains.

For the purposes of the present disclosure, these mechanical drive means will not be described in detail, because these drive systems are well known to the skilled person and especially because the present invention is not limited to a particular type of such drive means, and may be implemented in mobile cabinets that can be driven by mechanical drive means of any type.

Therefore, concerning such mechanical drive means, it shall be simply mentioned that they generally have a shank or a rotating input shaft 4 generally located at a first lateral side 8 of the mobile cabinet 2, i.e. at a wall of the mobile cabinet 2 that extends between the front side and the back side of the cabinet. Typically, in prior art mobile cabinets, such shank or rotating input shaft 4 has a handwheel or a functionally equivalent member mounted thereto.

Conversely, in the present invention, said shank of rotating input shaft 4 has a driven pinion 5 rotatably and integrally connected, e.g. keyed or otherwise fixed, thereto.

Such driven pinion 5 is part of the motorization kit 6 of the present invention for moving the mobile cabinets of a storage system with mobile cabinets. Preferably, the motorization kit 6 is located at a height of at least 50 cm, preferably at least 70 cm and more preferably from 90 cm to 105 cm, from the ground.

Particularly, each mobile cabinet 2 has its motorization kit 6 fixed thereto, comprising a box-like body 7, with all the components of the motorization kit 6 fixed or held therein in a protected position. The box-like body 7 is designed to be fixed to the first lateral side 8 of the mobile cabinet 2 to be moved, at said shank or rotating input shaft 4. For this purpose, the box-like body 7 has an opening coinciding with the driven pinion 5, through which said shank or rotating input shaft 4 of the mobile cabinet 2 may fit into the box-like body to engage the driven pinion 5.

More particularly, the motorization kit 6 comprises:

- an electric motor 9 integrally held and supported in the box-like body 7 (in the illustrated embodiment, the electric motor 7 consists of a gearmotor unit);
- said driven pinion 5;
- mechanical drive means 10 supported in the box-like body 7 for kinematically rotatably connecting the shaft of the electric motor 9 to its respective driven pinion 5, to transfer the torque of the motor 9 to the driven pinion 5 and rotate said shank or rotating input shaft 4 in either direction;
- electronic adjustment and control means 15 for managing the operation of the motor 9, which are held within the box-like body 7;
- actuation means 16 mounted on board the box-like body 7 and adapted to provide an enable signal to said electronic adjustment and control means, for rotary actuation of the motor in a predetermined direction of rotation and
- safety means 12 mounted on board the box-like body 7 and adapted to operate to cause the motor 9 to stop in response to a signal emitted as an obstacle is found along the path of the mobile cabinet 2 with the motorization kit 6 fixed thereto.

Preferably, said safety means 12 comprise a photocell sensor 12 that can detect the presence of a person or an object in the passageway defined between two spaced contiguous mobile cabinets 2.

Namely, a photocell-based intrusion detection system stops the movement of the mobile cabinets 6 by de-energizing the electric motors 9 both when an obstacle accesses the passageway before automatic termination of the opening cycle, and when the operator enters the passageway for consultation.

In order to ensure equal safety in both directions of movement of a mobile cabinet 2 along the rails 3, in each motorization kit 6, said safety means preferably consist of a first photocell sensor 12 located in such a position as to detect an obstacle between the front side of the cabinet 2 and the back side of the mobile cabinet next to it, and a second photocell sensor 12 to detect an obstacle between the back side of the cabinet 2 and the front side of the mobile cabinet next to it.

Each motorization kit 6 comprises:

- sensor means 13 for detecting contiguous cabinets and/or motorization kits, to adjust or stop the operation of their motor 9 according to the distance from a contiguous cabinet and/or motorization kit detected by these sensor means and
- proximity sensor means 14 for reducing the rotation speed of the motor to a value above zero, when the distance between two mobile cabinets 2 moving towards each other is lower than a predetermined threshold value.

In this example, said sensor means include photocell sensors 13, 14, although other types of sensors, such as microswitches, can be implemented, especially as sensors for adjusting or stopping the operation of their own motor 9 according to the value of proximity to a contiguous mobile cabinet 2 detected by the sensor means.

Once again, each motorization kit 6 should include a first series of said sensors located in such positions as to provide detections in a first direction of movement of the mobile cabinets 2 along said rails 3 and a second series of sensors located in such positions as to provide detections in the opposite direction of movement of the cabinets 2 along the rails 3.

Therefore, according to the preferred embodiment, each motorization kit 6 comprises three photocells for detections in a first direction of movement of the corresponding mobile cabinets 2 along the rails 3 and three further photocells for detections in the opposite direction of movement of the corresponding mobile cabinets 2, the photocells of each set of photocells being respectively designed for:

- detecting the intrusion of a person or an object in the passageway defined between two appropriately spaced contiguous mobile cabinets 2,
- detecting the motion of two contiguous mobile cabinets towards each other, such motion being stopped when the front side of a mobile cabinet 2 substantially contacts the back side of a second mobile cabinet 2, which more generally means that the motion of two mobile cabinets 9 towards each other is stopped as soon as the two mobile cabinets substantially lean against each other and
- reducing the speed of motion of two mobile cabinets 2 towards each other to a reduced value greater than zero, when the distance between such mobile cabinets moving towards each other is lower than a predetermined value.

Advantageously, in the last section of the motion of two mobile cabinets towards each other, said feature of reducing the speed of the mobile cabinets allows the two mobile cabinets 2 to come closer to each other at a lower speed, although greater than zero, to reduce the momentum of the mobile cabinet before stopping it.

Preferably, in the last section of the motion of the two mobile cabinets towards each other, said speed of the mobile cabinet is reduced by at least 30%, preferably 50%, relative to the speed at which the mobile cabinets are typically moved along the rails 3 before coming close to a contiguous cabinet.

It should be noted that such reduction of the speed of two mobile cabinets 2 moving towards each other may be obtained by reducing the rotation speed of the motor 9, e.g. by halving or otherwise reducing the supply voltage to the electric motor, and/or by further gearing down the motor to a lower rpm.

Advantageously, the electric motor 9 is a low voltage motor, where low voltage is intended as a voltage below 50 Volt.

Preferably, the motor 9 is a 24V motor powered by two 12V batteries in series, mounted on board the box-like body 7.

Alternatively, a 12V motor may be used, which is powered by one 12V battery or more 12V batteries in parallel, mounted on board the box-like body 7.

If the motor 9 is a stepper motor, then it may be advantageously controlled by said electronic adjustment and control means. Accordingly, the position and displacements of each mobile cabinet 2 relative to a starting point may be determined according to the angular position and the rpm of each stepper motor. This may afford the use of fewer photocell sensors to determine the position of each mobile cabinet 2 and the motorization kit 6 associated therewith.

Preferably, each mobile cabinet 2 has opposed electric contact means jutting out in both directions of movement of the mobile cabinet 2. When two mobile cabinets 2 are packed together, the electric contact means of the one are in electrical contact with the electric contact means of the other cabinet 2, so that electric communication is established between the electric contact means of the two mobile cabinets, which may be conveniently used to recharge the batteries of the mobile cabinets packed together, because the electric contact means of each mobile cabinet 2 are in electric communication with the storage batteries mounted on board their respective box-like bodies 7.

Preferably, the electric contact means of a head mobile cabinet 2 of said plurality of mobile cabinets are connected to the mains to allow recharging of the storage batteries of the various mobile cabinets 2 when the mobile cabinets 2 are packed together and their electric contact means are in mutual electric communication.

The storage system 1 of the invention also includes an electronic central control unit for supervising operation/movement and control of all the devices of the plurality of mobile cabinets 2. According to a preferred and advantageous embodiment, communication between said electronic central control unit and the individual devices of said plurality of mobile cabinets 2 is ensured by wireless communication means.

For this purpose, each motorization kit 6 is equipped with special wireless communication means powered by said batteries.

The feature of providing wireless communication means and powering the electric motor and the electric/electronic means by the storage battery held within the box-like body 7 avoids the presence of undesired wiring between mobile cabinets, and allows trouble-free access between two spaced contiguous mobile cabinets with a ladder.

The above mentioned actuation means designed to provide an enable signal to said electronic adjustment and control means, for rotary actuation of the electric motor in a predetermined direction of rotation, comprise switches that are mounted on board the box-like body 7 and can be manually operated from outside the motorization kit 6.

Preferably, said mechanical drive means supported by the box-like body 7 comprise a torque regulator device, which is adapted to stop torque transfer when the value of the resistant torque applied to the driven pinion 5 exceeds a preset threshold value that can be adjusted according to particular needs.

Preferably, said mechanical drive means supported by the box-like body 7 comprise a mechanical plug-in device, whose disengagement will release the rotation of the driven pinion 5 relative to the shaft of the motor 9.

With a mobile cabinet 2 as described above, whose shank/rotating input shaft 4 jutting out of the first lateral side 8 has a handwheel fixed thereto for rotatably actuating said shank/rotating input shaft 4 to obtain the displacement of said mobile cabinet 2 relative to the slide guides 3, the method of motorizing the drive of said mobile cabinet 2 consists of the steps of:

removing said handwheel from the shank/rotating input shaft 4 and fixing the box-like body 7 of the motorization kit 6 as described above to the first lateral side 8 of the mobile cabinet 2, so that the driven pinion 5 held within the box-like body 7 is rotatably integrally engaged with the shank/rotating input shaft 4.

As clearly shown in the above description, the motorization kit for a storage system with mobile cabinets of the present invention fulfills the above mentioned need and also obviates prior art drawbacks as set out in the introduction of this disclosure. Such motorization kit may be applied to both a newly installed mobile cabinet and an existing mobile cabinet, having the classical handwheel rotary actuation device.

Motorization of a mobile cabinet simply requires the box-like body 7 of the motorization kit to be fastened (e.g. by bolts) to the sidewall of a cabinet, with the driven pinion 5 engaging in the shank or input shaft 4 to be rotatably integral therewith (the hub of the driven pinion 5 is sufficient, to provide a screw clamp).

Once the motorization kit 6 is applied, it requires no further installation or programming action, as all its operation is under the wireless control of the electronic central control unit. The only value that may be required to be set in said electronic central control unit, if the mobile cabinets have a non-standard thickness in the movement direction, is the particular thickness of the mobile cabinet to be driven.

A further advantage of the motorization kit for a storage system with mobile cabinets of the present invention is the possibility of avoiding wiring of the various parts of the devices and individual positioning of the sensors, as the latter may be conveniently attached and integrated in the box-like body.

Each motor, once it is de-energized, will act as a brake to prevent undesired displacement of mobile cabinets, e.g. due to a slight inclination of the floor with the rails.

An additional advantage of the motorization kit for a storage system with mobile cabinets of the present invention is the inexpensiveness of the special, particular solution that has been provided, which allows low cost manufacture of the motorization kit and low cost installation thereof, as it may be also installed by non skilled personnel.

Advantageously, a storage system with mobile cabinets may be quickly motorized by removing the handwheel and fixing the motorization kit instead of it, without requiring wirings or adjustments.

Advantageously, the storage system with mobile cabinets motorized with the motorization kit of the present invention has no wiring between the mobile cabinets.

Those skilled in the art will obviously appreciate that a number of changes and variants may be made to the motorization kit for a storage system with mobile cabinets as described hereinbefore, without departure from the scope of the invention, as defined in the following claims.

The invention claimed is:

1. A motorization kit for a storage system with mobile cabinets (2) sliding along support guides (3), comprising a box-like body (7) which is designed to be fixed to a lateral side (8) of a mobile cabinet (2) to be moved and in that it further comprises:

an electric motor (9) held within said box-like body (7);

a driven pinion (5) held in said box-like body (7) and designed to be keyed to the drive shank (4) of a mobile cabinet (2) to be moved, mechanical drive means supported in said box-like body (7), said drive means rotatably connecting the rotating shaft of said electric motor (9) and said driven pinion (5), to transfer the torque of said motor to said driven pinion (5);

electronic adjustment and control means (15) for managing the operation of said motor (9), which are held within the box-like body;

actuation means (16) supported by said box-like body (7) for providing an enable signal to said electronic adjustment and control means, for rotary actuation of said motor in a predetermined direction of rotation;

safety means (12) supported by said box-like body (7), for causing said motor to stop in response to a signal emitted as an obstacle is found along the path of the mobile cabinet (2) with the motorization kit fixed thereto;

first sensor means (13, 14) for detecting contiguous cabinets/control devices kits, and for adjusting or stopping the operation of said motor according to the distance from a contiguous cabinet/motorization kit detected by said first sensor means;

wherein said first sensor means include proximity sensor means (14) for detecting the distance of said motorization kit from a cabinet/motorization kit next to it, and configured to cause a reduction of the rotation speed of said motor to a value greater than zero when said detected distance is lower than a preset threshold value; and storage batteries held within said box-like body (7) for powering said electric motor, said electronic adjustment and control means (15), said actuation means (16), said safety means (12) and said first sensor means (13, 14), wherein said box-like body has no external wiring means for permanent connection to the mains and/or other motorization kits.

2. A motorization kit as claimed in claim 1, wherein said safety means and/or said first sensor means (13, 14) include photocell sensors (12).

3. A motorization kit as claimed in claim 1, wherein said electric motor (9) is a stepper motor controlled by said electronic adjustment and control means (15).

4. A motorization kit as claimed in claim 1, wherein said electric motor (9) is a 24V or 12V electric motor.

5. A motorization kit as claimed in claim 1, comprising wireless communication means for interfacing said electronic adjustment and control means (15) with an electronic central control unit designed to manage and supervise the operation and control of a plurality of said motorization kits.

6. A motorization kit as claimed in claim 1, wherein said actuation means (16) designed to provide an enable signal to said electronic adjustment and control means (15), for rotary actuation of said electric motor in a predetermined direction of rotation, comprise switches that are mounted on board said box-like body (7) and can be manually operated from outside said motorization kit.

7. A motorization kit as claimed in claim 1, wherein said mechanical drive means comprise a torque regulator device, which is adapted to stop torque transfer when the value of the resistant torque applied to said driven pinion (5) exceeds a preset threshold value.

8. A motorization kit as claimed in claim 1, wherein said mechanical drive means supported by said box-like body comprise a mechanical plug-in member, whose disengagement can release the rotation of said driven pinion (5) relative to the shaft of said motor (9).

9. A storage system comprising one or more mobile cabinets (2) positioned for sliding along support guides (3), and further including a motorization kit comprising a box-like body (7) which is fixed to a lateral side (8) of a mobile cabinet (2);

wherein the mobile cabinet fixed to the motorization kit comprises a front side, a rear side, two opposed lateral sides, sliding means for sliding along support guides (3), and mechanical actuation means driveably engaged to a drive shank (4) for causing the mobile cabinet to move along the support guides (3);

wherein the motorization kit further comprises:

an electric motor (9) held within said box-like body (7);

a driven pinion (5) held in said box-like body (7) and keyed to the drive shank (4) of the mobile cabinet (2) to be moved, mechanical drive means supported in said box-like body (7), said drive means rotatably connecting a rotating shaft of said electric motor (9) and said driven pinion (5), and adapted to transfer torque of said motor to said driven pinion (5);

electronic adjustment and control means (15) for managing the operation of said motor (9), and which are held within the box-like body;

actuation means (16) supported by said box-like body (7) for providing an enable signal to said electronic adjustment and control means, for rotary actuation of said motor in a predetermined direction of rotation;

safety means (12) supported by said box-like body (7), for causing said motor to stop in response to a signal emitted as an obstacle is found along the path of the mobile cabinet (2) with the motorization kit fixed thereto;

first sensor means (13, 14) for detecting contiguous cabinets/control devices kits, and for adjusting or stopping the operation of said motor according to the distance from a contiguous cabinet/motorization kit detected by said sensor means;

wherein the first sensor means include proximity sensor means (14) for detecting the distance of said motorization kit from an adjacent cabinet/motorization kit, and is adapted to cause a reduction of the rotation speed of the motor to a value greater than zero, when the detected distance is lower than a preset threshold value; and storage batteries held within said box-like body (7) for powering said electric motor, said electronic adjustment and control means (15), said actuation means (16), said safety means (12), and said first sensor means (13, 14);

wherein said box-like body has no external wiring means for permanent connection to other motorization kits or other cabinets.

10. A mobile cabinet (2) as claimed in claim 9, wherein:

said mobile cabinet (2) has opposed electric contact means jutting out in both directions of movement to contact corresponding electric contact means of contiguous mobile cabinets, when said mobile cabinets (2) lean against each other, to establish an electric communication between the mobile cabinets leaning against each other and said electric contact means are in electric communication with the storage batteries held in the box-like body (7) of the motorization kit (6).

11. A storage system with mobile cabinets comprising a plurality of mobile cabinets (6) as claimed in claim 9, which are slideably mounted to common slide guides (3).

12. A storage system with mobile cabinets (2) as claimed in claim 11, comprising an electronic central control unit which is designed to manage and supervise operation and control of a plurality of said motorization kits (6), wherein communication between said electronic central control unit and the electronic adjustment and control means (15) of each motorization kit is obtained by wireless communication means, the mobile cabinets (2) of said plurality of mobile cabinets (2) not being connected together by wires.

13. A storage system with mobile cabinets (2) as claimed in claim 11, wherein only the electric contact means of one or both of the head mobile cabinets (2) are in electric communication with the mains.

14. A method of using a motorized mobile cabinet (2) defined by a front side, a rear side and two opposed lateral sides, said mobile cabinet comprising:

sliding means for sliding along slide guides (3), and mechanical actuation means for causing the mobile cabinet to move along said slide guides (3), said mechanical actuation means comprise a shank/rotating input shaft (4) rotatably supported by said mobile cabinet (2) in such a manner as to jut out of a first lateral side (8) of said mobile cabinet (2) and be accessible for rotatably actuating said shank/rotating input shaft (4) in a first direction of rotation or in the direction opposite thereto, thereby causing said mobile cabinet (2) to move in a first direction or in a direction opposite thereto relative to the slide guides (3), and a motorization kit as claimed in claim 1 fixed to said first lateral side (8) of said mobile cabinet (2), so that said driven pinion (5) held in said box-like body (7) is rotatably engaged with said shank/rotating input shaft (4), sensor means (14) for detecting the distance of said motorization kit from a cabinet/motorization kit next to it, wherein the method comprises the steps of:

moving the mobile cabinet (2) and the attached motorization kit along the slide guides (3) towards an adjacent second cabinet/motorization kit;

detecting the distance of said motorization kit from the second cabinet/motorization kit;

reducing the speed of motion of the mobile cabinet (2) towards the second cabinet/motorization kit to a reduced value greater than zero when the distance between such mobile cabinet (2) moving towards said second cabinet/motorization kit next to it is lower than a predetermined value, and stopping said mobile cabinet when a front side of said mobile cabinet substantially contacts the back side of said second cabinet/motorization kit next to it.

15. A method of motorizing a mobile cabinet according to claim 14, wherein said speed of said mobile cabinet is reduced by at least 30%, relative to the speed at which the mobile cabinet is typically moved along said rails before coming close to said second cabinet/motorization kit next to said mobile cabinet.

16. A method of motorizing a mobile cabinet according to claim 14, wherein said speed of said mobile cabinet is reduced by at least 50%, relative to the speed at which the mobile cabinet is typically moved along said rails before coming close to said second cabinet/motorization kit next to said mobile cabinet.

* * * * *